United States Patent [19]

Schildknecht et al.

[11] Patent Number: 5,067,409

[45] Date of Patent: Nov. 26, 1991

[54] SHAPED CHARGE FOR COMBATING ARMORED TARGETS

[75] Inventors: Manfred Schildknecht, Friedrichsdorf; Günter Honcia, Kelkheim-Eppenheim, both of Fed. Rep. of Germany

[73] Assignee: Battelle Institut e.V., Frankfurt, Fed. Rep. of Germany

[21] Appl. No.: 929,768

[22] Filed: Nov. 12, 1986

[51] Int. Cl.[5] ..... F42B 1/028; F42B 12/10

[52] U.S. Cl. ..... 102/476; 102/307

[58] Field of Search ..... 102/305–310, 102/475–476, 703

[56] References Cited

U.S. PATENT DOCUMENTS

| | | | |
|---|---|---|---|
| H 33 | 3/1986 | Jameson et al. | 102/476 |
| 3,732,818 | 5/1973 | Thomanek | 102/306 |
| 3,967,553 | 7/1976 | Keraus et al. | 102/476 |
| 4,262,596 | 4/1981 | Allier et al. | 102/476 |
| 4,374,495 | 2/1983 | Thomanek | 102/476 |

*Primary Examiner*—Harold Tudor

*Attorney, Agent, or Firm*—Spencer & Frank

[57] ABSTRACT

A shaped charge for missiles which are provided for defeating armored vehicles in such a manner that the flight path of the missile is beside, below or above the target. The warhead is ignited at an instant when the missile is either beside, below or above a weakly armored portion of the target. The shaped charge is characterized by a hollow body (liner), which is surrounded by an explosive charge. To compensate for the velocity of the missile, the explosive charge is designed such that the charge axis forms an angle with the axis of the inner counter of the hollow body (liner), and such that sections in planes normal to the axis of the inner liner contour have circular or elliptic cross sections. The liner may be designed in a way that the axes of the inner and the outer contours can be translated with respect to each other and/or inclined by a small angle toward each other. Also the cone angles of the inner and outer contours of the liner may be different.

20 Claims, 1 Drawing Sheet

SHAPED CHARGE FOR COMBATING ARMORED TARGETS

BACKGROUND OF THE INVENTION

The invention relates to a shaped charge for combating armored targets, with a liner in the form of a metallic hollow body which is surrounded by an explosive charge, the axis of the liner deviating from the axis of the explosive charge.

Because of the great progress achieved in the field of protective armor during the last 15 years increasingly large, warhead calibers and missible length, e.g., for tandem charges, are required, to defeat armored vehicles with shaped charges by front attack. As a result, it becomes increasingly impossible to defeat tanks with man-portable antiarmor weapons by a frontal artacx.

Therefore, missiles have been developed for some years which do not attack the vehicle from the front where it is provided with the strongest armor, but rather at more weakly armored sections. This is achieved by a flight path which leads the missile either beside, below or above the target. The shaped-charge warhead is arranged in the missile in such a manner that the axis of the shaped charge forms an angle with the axis of the missile which may amount, for example, to 90° . The shaped charge warhead is ignited at an instant when the missile is either beside, below or above a weakly armored position of the vehicle, e. g., the roof. If conventional shaped charges are used for such an overfly attack, the penetration of the shaped-charge jet, compared with the penetration of the same charge fired at rest, is strongly reduced by the fact that the velocity of the missile is superposed on the velocity of the individual jet particles. As the different particles of the shaped-charge jet in general have different velocities, a velocity component. whose direction deviates from the direction of the shaped-charge axis causes the elements of the shaped-charge jet to hit the tank surface at different positions cr to touch the walls of the crater produced by the previous jet particles. This effect results in a drastic reduction of the penetration depth, e. g., typically to about 25 %, for a conventionally shaped charge. A known approach to a solution consists in accelerating the shaped charge inside the missile, to the velocity of the missile, but opposite to the flight direction. The charge will be ignited when the final velocity is reached. Acceleration of the shaped charge can be achieved, e. g., by means of a pyrotechnical propellant charge. This method is not very effective since a major dead volume for accelerating the charge has to be provided inside the missile which cannot be used otherwise.

SUMMARY OF THE INVENTION

The object of the present invention is to develop a shaped charge with the feature that, for each individual element of the shaped-charge jet, a velocity component is generated —in addition to the axial velocity of the shaped-charge liner —which corresponds to the velocity of the missile but is directed opposite to the flight direction. As a result, the jet particles are to hit the surface of the armor only at one point, in spite of the velocity of the missile. The penetration performance, i. e., the crater depth, is to be markedly improved as compared to that of a conventional shaped-charge jet.

According to the invention, this object is achieved by basically an explosive charge has the shape of an or inclined a shaped charged of the above described type, including an explosive charge having a hollow inwardly directed metallic liner disposed in one surface and with the axis of the liner deviating from the axis of the missle carrying the shaped charge, wherein the cylinder whose axis forms an angle with the axis of the liner which is surrounded by the charge. Advantageous improvements of the shaped charge according to the invention are likewise described.

The shaped charges according to the invention are mounted in missiles which defeat the target at weakly armored positions during passage or overflight. The shaped charge is arranged in the missile in such a manner that the missile axis and the axis of the shaped-charge liner form an angle between 20° and 160° , for example 90° .

In the case of conventional shaped charges the elements of the liner, which normally consists of copper and has the shape of a hollow cone, are accelerated in the direction of the cone axis by a detonation wave which acts on the outer cone surface, with equal momentum over the perimeter, in planes normal to the cone axis. As a result the metal liner is hydrodynamically transformed into a jet. The uniform momentum of the liner elements generated by the detonation wave produces a shaped-charge jet whose velocity is directed toward the shaped-charge axis.

Surprisingly, a velocity component in a direction normal to the axis of the shaped-charge liner is generated by shaping the explosive which surrounds the liner such that the thickness of the explosive has different values over the periphery ir planes normal to the inner cone axis.

The shaped charge according to the invention, if used in an overfly weapon system in such a manner that the axis of the shaped-charge liner is inclined by an angle of about 90 degree with respect to the direction of the missile axis, shows the advantage over known shaped charges of the same outside dimensions that it leads to a significant higher penetration depth in the armor. As compared with systems in which the velocity of the missile is compensated by accelerating a conventionally shaped charge to the missile velocity inside the missile by a propellant charge immediately before ignition, the shaped charge according to the invention has the advantage that no additional volume is necessary for the acceleration path inside the missile. Furthermore, no additional weight is required for accelerating the charge. As compared with overfly systems for which shaped charges of conventional design, are used with angles of about 45° between missile axis and shaped-charge axis, for a partial compensation of the velocity component of the missile, the proposed shaped charge has the advantage of low volume requirement at markedly higher penetration performance.

BRIEF DESCRIPTION OF THE DRAWINGS

The invention is explained in more detail on the basis of the attached drawings, wherein.

DETAILED DESCRIPTION OF THE PREFERRED EMBODIMENT

Figure 1:
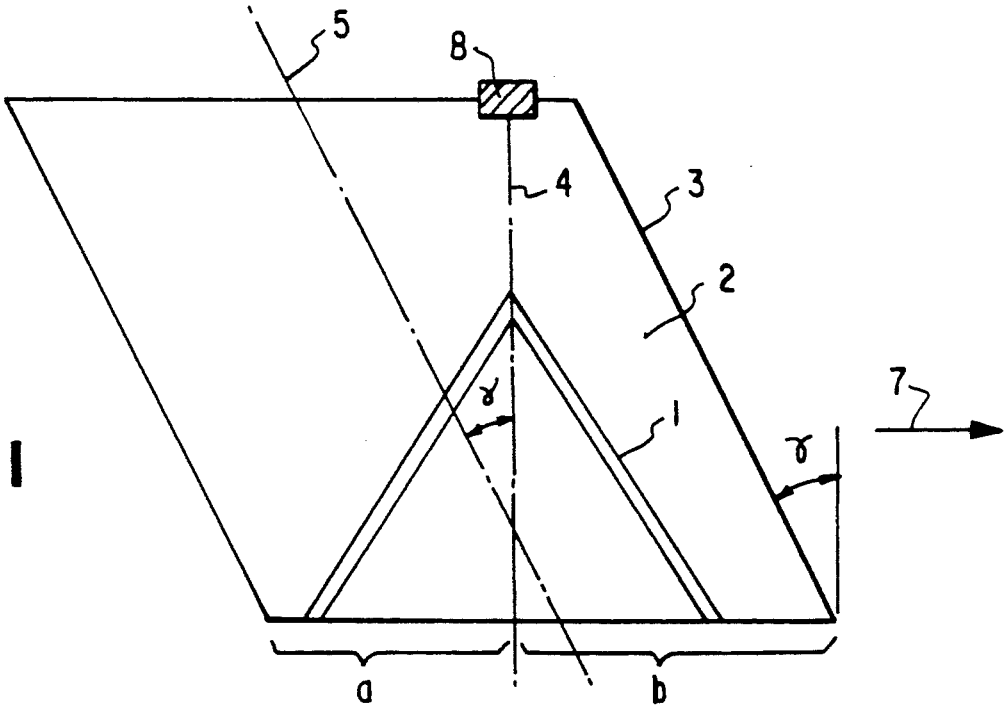
FIG. 1 shows a longitudinal section of one embodiment of shaped charge according to the invention.

According to FIG. 1, a hollow-cone-shaped liner 1 is mounted in an explosive device or charge 2 whose outer element or surface 3 forms an angle $\gamma$ with the longitudinal axis 4 of the inner contour of the shaped-charge liner 1. This means that the longitudinal axis 5 of the explosive charge 2, which has the shape of an oblique or inclined cylinder, forms an angle $\gamma$ with the axis 4 of the liner. This angle $\gamma$ has values between 1 and 15°, preferably between 3 and 8°. For the sections in planes normal to the axis 4 of the liner 1, the oblique cylinder 2 may have either a circular or an elliptic cross section.

A preferable shape, however, is that of an oblique circular cylinder. The intersection point of the cone axis 4 and the axis 5 of the explosive charge may be positioned outside the plane in which the base of the liner 1 is situated.

The shaped charge 1,2 is disposed in a missle or projectile (not shown) so that the axis 4 of the liner 1 forms an angle between 20° and 160°, e.g. 90°0, with the longitudinal axis of the missle. In the illustration of FIG. 1, the axis 4 forms an angle of 90° with the axis of the missle which is parallel to the direction of flight of the missle as indicated by the arrow 7. The detonator or point of ignition 8 for the explosive charge 2 is, as shown, disposed on the axis 4 at the opposite end surface of the charge 2.

The metallic liner 1 preferably has the shape of a hollow circular cone. Deviations from this shape are also possible. Besides the hollow-cone-shaped liners with the abovedescribed properties, it is also possible, for example, to use tulip- or bottle-shaped liners. The base of the liner 1, however, should preferably be circular. According to a preferred embodiment, the diameter of the base of the liner 1 is smaller than the diameter of the base of the oblique cylinder 2. In this example, the axis 4 of the liner shows a spacing from the center of the base of the oblique cylinder 2, i. e. the distance "a" is smaller than the distance "b", an accordingly, the distances from the edges of the base of the liner 1 to the edges of the base of the oblique cylinder 2 are different. For a liner diameter of 40 mm, for example, the distances a and b may be 24 mm and 26 mm, respectively.

Figure 2:
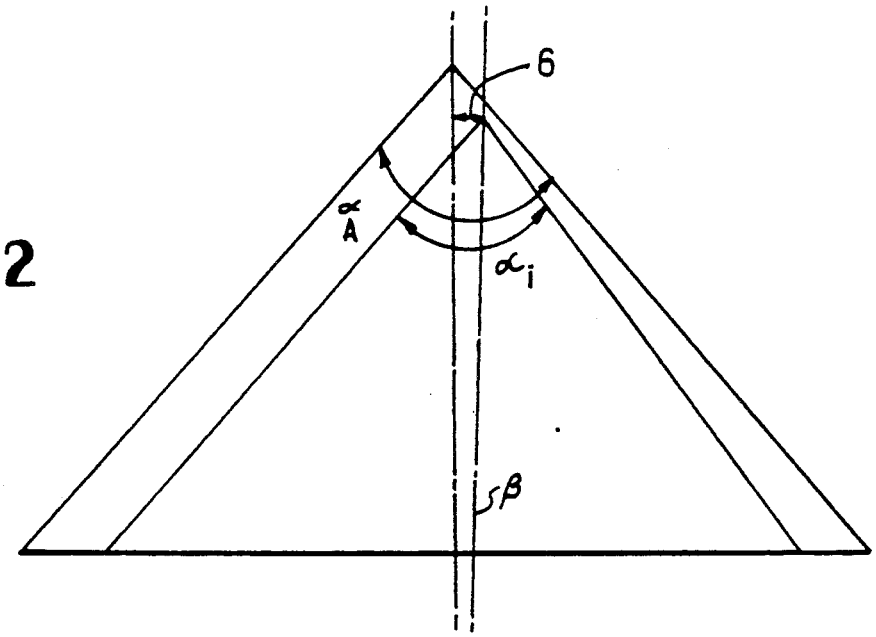
FIG. 2 shows a longitudinal section of a liner according to the invention, with non-uniform wall thicknesses.

For exact adjustment of the axial velocity to the desired value for all the mass elements from different heights of the liner 1, it is possible to use —in addition to the above-described measures —liners where the axes of the inner and outer contours are displaced with respect to each other by a distance 6 and/or where the axes of the inner and outer contours are inclined towards each other by an angle $\beta$. This can be seen from FIG. 2. For the same purpose, it is also possible to use liners with the above-described properties which, however, have the additional feature that the cone angle of the outer contour $\alpha_A$ of the liner deviates from that of its inner contour $\alpha_i$ by a small angle $\Delta\alpha$.

We claim:

1. In a shaped hollow charge disposed in a missle for combatting armored targets and including an explosive charge body having a liner, in the form of a metallic hollow body, extending inwardly from a base end of the charge body, and with said liner having a longitudinal axis extending from said base end and forming an angle between 20° and 160° with the longitudinal axis of the missle; the improvement wherein said explosive charge body has the shape of an oblique cylinder which is inclined with respect to said base end and whose longitudinal axis forms an angle with said longitudinal axis of said liner.

2. Shaped charge as claimed in claim 1 wherein:

said liner and said charge body each have circular cross sections at said base end; and the diameter of the base of the liner is smaller than the diameter of the base of the oblique charge cylinder.

3. Shaped charge as claimed in claim 1 wherein the axis (4) of the liner is spaced from the center of the base of the oblique charge cylinder (2).

4. Shaped charge as claimed in claim 3 wherein the distance (a) between the liner axis (4) and the edge of the oblique charge cylinder (2) at the base end is smaller in the direction of inclination of the oblique charge cylinder with respect to the axis of the liner than in the opposite direction.

5. Shaped charge as claimed in claim 1 wherein the angle ($\alpha$) between the axis (4) of the liner and the axis (5) of the oblique charge cylinder is in the range between 1 and 15°.

6. A shaped charge as claimed in claim 5 wherein said angle between said axis of said liner and said axis of said oblique charge cylinder is between 2 and 6°.

7. Shaped charge as claimed in claim 1 wherein said charge cylinder is an oblique circular charge cylinder.

8. Shaped charge as claimed in claim 1 wherein the base of the liner (1) is circular.

9. Shaped charge as claimed in claim 8 wherein the cone angles ($\alpha_A$, $\alpha_i$) of the inner and outer contours of the liner (1) are different.

10. Shaped charge as claimed in claim 8 wherein the liner (1) has the shape of a hollow circular cone.

11. A shaped charge as claimed in claim 10 wherein the liner has different wall thicknesses along its periphery.

12. A shaped charge as claimed in claim 11 wherein the longitudinal axes of the inner and outer contours of said liner are laterally translated with respect to one another.

13. A shaped charge as claimed in claim 12 wherein said axes of said inner and outer contours are inclined toward each other by a small angle.

14. A shaped charge as claimed in claim 13 wherein the cone angles of said inner and outer contours of said liner are different.

15. A shaped charge as claimed in claim 10 wherein said charge cylinder is an oblique circular charge cylinder.

16. A shaped charge as claimed in claim 15 wherein said angle between said axis of said liner and said longitudinal axis of said missile is 90°.

17. Shape charged as claimed in claim 1 wherein the liner has different wall thicknesses along its periphery.

18. Shaped charge as claimed in claim 17 wherein the axes of the inner and outer contours of the liner (1) are translated with respect to each other and are inclined towards each other by a small angle.

19. A shaped charge as claimed in claim 1 wherein said angle between said axis of said liner and said axis of said missle is 90°.

20. A shaped charge as claimed in claim 11 wherein the point of detonation of said charge body is disposed on said axis of said liner.

* * * * *